US005957029A

United States Patent [19]

Boyer et al.

[11] Patent Number: 5,957,029

[45] Date of Patent: Sep. 28, 1999

[54] LINEAR THRUSTER

[75] Inventors: Peter W. Boyer, Manteno; Steven J. Breese, Plainfield; Daniel L. Choisser, Frankfort; Kevin R. Douglas, Lockport; David S. Harris, Naperville, all of Ill.; John W. Langer, Sturbridge; Michael T. Starr, Shrewsbury, both of Mass.; Mark A. Tichgelaar, Lansing, Ill.

[73] Assignee: Bimba Manufacturing Co., Monee, Ill.

[21] Appl. No.: 08/934,256

[22] Filed: Sep. 19, 1997

[51] Int. Cl.[6] ..... F01B 25/26

[52] U.S. Cl. ..... 92/5 R; 92/13.5; 92/117 A; 92/107; 92/165 PR

[58] Field of Search ..... 92/5 R, 13.5, 117 R, 92/117 A, 107, 108, 165 R, 165 PR, 177

[56] References Cited

U.S. PATENT DOCUMENTS

| | | |
|---|---|---|
| 2,008,128 | 7/1935 | Condon et al. . |
| 3,563,136 | 2/1971 | Valenti . |
| 4,130,205 | 12/1978 | Luthi . |
| 4,716,803 | 1/1988 | Waltonen . |
| 4,750,408 | 6/1988 | Stoll . |
| 4,793,241 | 12/1988 | Mano et al. . |
| 4,961,372 | 10/1990 | Leonhartsberger . |
| 5,172,625 | 12/1992 | Latham . |
| 5,299,489 | 4/1994 | Obrecht et al. . |
| 5,469,775 | 11/1995 | Stoll et al. . |
| 5,609,091 | 3/1997 | Stoll . |

FOREIGN PATENT DOCUMENTS

| | | |
|---|---|---|
| 55103250 | 8/1980 | Japan . |
| 5686210 | 7/1981 | Japan . |

*Primary Examiner*—Thomas E. Denion
*Attorney, Agent, or Firm*—Lockwood, Alex, Fitz-Gibbon & Cummings

[57] ABSTRACT

A linear thruster is disclosed in which a load beam is linearly moved by fluid power relative to a guide beam and a piston. The beams are multisided in cross-section to substantially increase the linear bearing area between the bodies and, thereby, substantially increase the strength of the linear thruster against side forces as well as moments to which the linear thruster might subjected. Internal positioning of the components and energy transmission are maximized and the stroke may be variably adjusted.

31 Claims, 6 Drawing Sheets

LINEAR THRUSTER

BACKGROUND AND SUMMARY OF INVENTION

The present invention is directed to linear thrusters and, more particularly, to fluid operated linear thrusters which are significantly stronger yet more compact and simpler in construction than the prior linear thrusters.

A wide variety of fluid operated linear thrusters have been available in the past. These have been employed for example for the positioning of work pieces or tools on production lines. These prior linear thrusters typically are non-rotatable and include a fluid operated piston and cylinder which moves a tooling plate back and forth in a linear reciprocating fashion, and a pair of spaced guide shafts which are supported by linear slide bearings, and which stabilize the thruster against rotation, strengthen it against side forces and moments and guide the tooling plate during operation. Although the prior linear thrusters have performed well in the many applications in which they have been used, their usefulness is somewhat limited by the maximum side loads, moments and deflection to which they may be subjected during use, particularly at their maximum stroke. The maximum loads and moments that can be accommodated by the described prior linear thrusters rapidly decrease in magnitude as the stroke length of the linear thruster increases. Thus, either the loads, moments and/or deflections must be limited for a given sized and stroke linear thruster, and if greater loads, moments or deflections must be accommodated, the size, bulkiness and volumetric space requirements of the prior linear thrusters must also be substantially increased.

It has been proposed to eliminate the spaced guide shafts of the prior linear thrusters and, instead, provide a stationary guide beam and a moveable load beam surrounding the fluid operated piston and cylinder. This load beam permits a substantial increase in the support and guide surfaces making possible substantial reductions in deflection and increases in the resistance to side loads and moments, particularly where the cross-section of the load beam is non-circular and multisided in shape. It is a principal purpose of the present invention to further substantially improve upon such multisided cross-section linear thrusters.

In the linear thrusters incorporating the principles of the present invention, deflection can be substantially decreased and maximum side loads and moments can be substantially increased, while at the same time reducing the complexity and expense of the linear thrusters of the present invention. Moreover, "pinch points" which frequently existed in the typical prior linear thruster constructions, i.e. locations between which human body parts may be caught or pinched as the parts of the thruster move relative to each other, can be essentially eliminated in the linear thrusters incorporating the principles of the present invention. Significantly, the volumetric space requirements of the linear thrusters of the present invention also may be substantially and considerably reduced over the requirements of the prior linear thrusters, thereby permitting substantial miniaturization and increased compactness of systems incorporating the linear thrusters of the present invention. Additionally, the linear thrusters of the invention are receptive to the internal placement of many of the components which were previously mounted externally of the thruster, and all of the fittings for the operating fluid may be positioned at one end of the thruster to further facilitate increased volumetric space efficiency and compactness.

One important feature of the present invention is that the fluid power cylinder for the operation of the linear thruster may be formed as an intimate part of the load beam and move with it, and the piston may be fixed. This permits a substantial reduction in material needed to form the cylinder because the cylinder is directly supported by the load beam. Moreover, the pressurized operating fluid may be readily communicated to and from piston through the piston rod because both are stationary. This greatly reduces the complexity of the thruster and shortens the fluid path to permit reduction in size and weight of the linear thruster and improve its strength.

Another important advantage of the linear thrusters incorporating the principles of the present invention are that a number and variety of different features may be provided which may be located internally of the linear thruster. This streamlines the exterior of the thruster which permits the improved ability to clean the work area, reduction in possible personnel hazards and damage to and by exteriorly located attachments. Such features which may be located internally may for example include stroke adjustment components, position sensing components and the communication of the electrical or fluid energy to the distally located tooling plate or tool mounted thereto.

Still another principal advantage of the present invention is that the exterior of the linear thruster may be formed, for example by extrusion during manufacture, with useful ridges, grooves, and channels which may be capable of accommodating fastening mechanisms for easily fastening the linear thruster itself to a base plate, or to accommodate position sensors.

Still another principal advantage of the present invention is that it is relatively simple and inexpensive to manufacture and accommodates relatively large tolerances without detrimental effect to its operation. Moreover, the linear thruster of the present invention may be simply adapted to clean room use.

In one principal aspect of the present invention, a fluid operated linear thruster comprises a guide beam having an elongate passage therein defined by internal walls in the guide beam, and a load beam positioned in the passage of the guide beam for reciprocation therein. The load beam has an outer wall which is sized and shaped so as to be supported and guided at least at two spaced locations on the internal walls of the guide beam during reciprocation of the load beam in the passage of the guide beam, and at least one of the aforementioned passage of the guide beam and/or outer wall of the load beam is multisided in cross-section. The load beam includes a mounting for mounting a load thereon for movement with the reciprocating load beam. A piston is located in the load beam and the load beam is reciprocally movable relative to the piston. A fluid inlet communicates a source of fluid under pressure to at least one side of the piston to urge the load beam to reciprocally move in the passage and relative to the piston, and between a first position and a second position while being supported and guided by the aforementioned at least two spaced locations.

In another principal aspect of the present invention, both the passage in the guide beam and the outer wall of the load beam are multisided in cross-section, and preferably square in cross-section.

In still another principal aspect of the present invention, the load beam is located substantially within the guide beam when it is in its first position, the guide beam has first and second opposite ends, and the load beam extends from the first end of the guide beam when the load beam is in its aforementioned second position.

In still another principal aspect of the present invention, the fluid inlet includes at least first and second fluid inlets to communicate a source of fluid under pressure to opposite sides of the piston, and both the first and second fluid inlets are positioned on the guide beam adjacent the second end of the guide beam.

In still another principal aspect of the present invention, the piston includes a piston rod which is mounted, preferably stationarily, at the second end of the guide beam.

In still another principal aspect of the present invention, the fluid inlet communicates with the piston rod to communicate fluid under pressure to at least one and preferably both sides of the piston through the piston rod.

In still another principal aspect of the present invention, the piston is stationarily mounted relative to the guide beam and the load beam is reciprocally moveable relative to the piston.

In still another principal aspect of the present invention, the guide beam is extruded to form its multisided cross-section and one or more channels are extruded on the exterior of the guide beam so that the channels may perform a variety of functions including reception of fastenings for mounting the linear thruster to a base and/or attachment of position sensing means for sensing the position of the load beam.

In still another principal aspect of the present invention, the load beam has an elongate axis and a plurality of channels opening to at least one end of the load beam. The channels are spaced from each other, extend longitudinally of and within the load beam and substantially parallel to and radially spaced from the axis. At least one such channel extends the length of the load beam and is constructed and arranged relative to a tooling plate on the end of the load beam to communicate fluid and/or electrical energy to the tooling plate to operate a tool when it is mounted on the tooling plate. An adjustment assembly may also be provided for adjusting the distance between the first and second positions of the load beam and may include elements which cooperate with at least one of the channels in the load beam.

In still another principal aspect of the present invention, one or all of the guide beam internal walls and load beam outer walls is coated with a low friction substance, and preferably a solid polymer.

In still another principal aspect of the present invention, the guide beam internal walls and load beam outer wall are spaced from each other and at least one bearing member is positioned in the space between the walls to support and guide the load beam at spaced locations during the reciprocation of the load beam, and the bearing member is preferably formed of a solid, low friction polymer.

These and other objects, features and advantages of the present invention will be more clearly understood through a consideration of the following detailed description.

BRIEF DESCRIPTION OF THE DRAWINGS

In the course of this description reference will frequently be made to the attached drawings in which.

DESCRIPTION OF THE PREFERRED EMBODIMENTS

Figure 1:
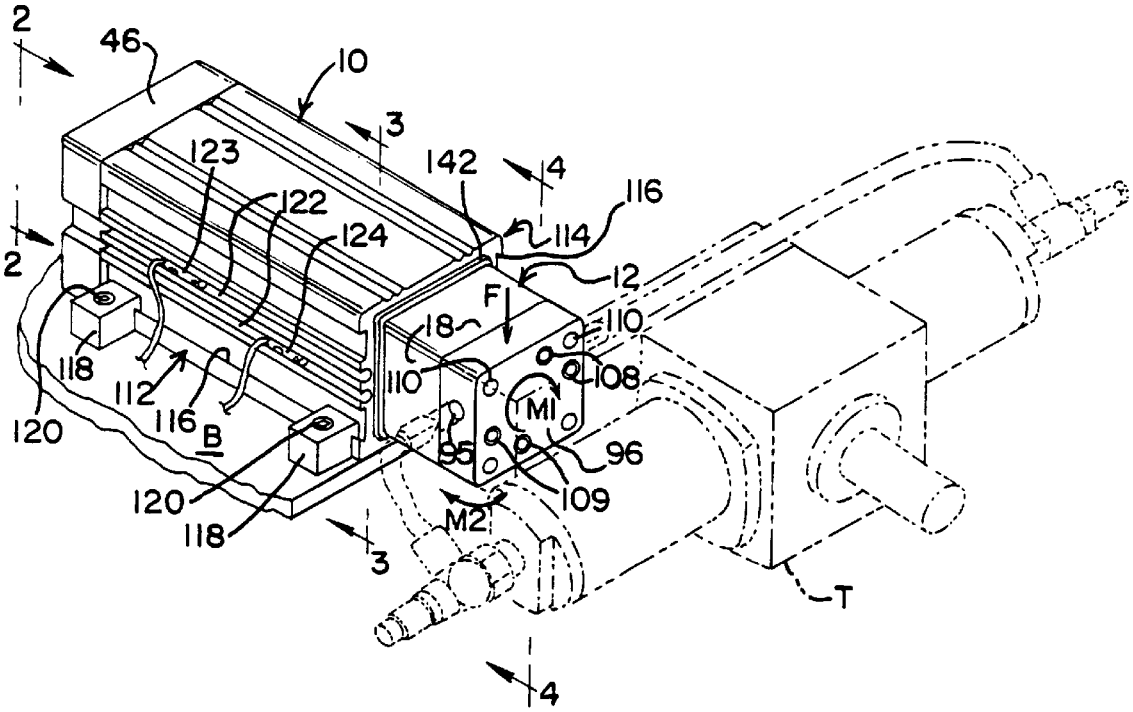
FIG. 1 is an overall, perspective view of a fluid powered linear thruster incorporating the principles of the present invention.

A preferred embodiment of linear thruster constructed in accordance with the principles of the present invention is shown in the drawings. The linear thruster comprises a pair of beams including a guide beam 10 and a somewhat smaller in cross-section load beam 12. As best seen in FIGS. 3 and 5–9, the guide beam 10 has a plurality of inner walls 14, which generally define a passage 16 which is multisided in cross-sectional shape, and preferably substantially polygonal in cross-sectional shape and, more preferably, square in cross-section as shown in the drawings. As employed in the present invention, the term "multisided" includes planar geometric shapes having a plurality of sides and/or angles and preferably two or more sides and/or angles, and the sides may or may not either be flat or equilateral in length, although equilateral lengths are presently preferred due to ease and cost of manufacture. Although at least some if not all of the sides are preferably substantially flat, they need not be to be "multisided" according to the invention, so long as there are angles between at least some of the sides, such as cross-sectional shapes which are semi-circular, scalloped, heart or kidney shaped.

The load beam 12 is formed with a plurality of outer walls 18 which also define a multisided cross-sectional shape, and preferably substantially polygonal in cross-section and, more preferably square in cross-section as shown in the drawings. The cross-sectional shapes of the guide and load beams 10 and 12, respectively, are preferably the same. However, the cross-sectional dimensions of the load beam 12, are somewhat smaller than the overall cross-sectional dimensions of the guide beam 10 so that the load beam 12 is adapted to be received into the passage 16 through the guide beam 10, is reciprocally moveable in the passage and will be linearly supported and guided over a considerable number and/or size of spaced locations or areas on the interior walls 14 of the guide beam 10 for the reasons and in the manner to be discussed below.

Figure 3:
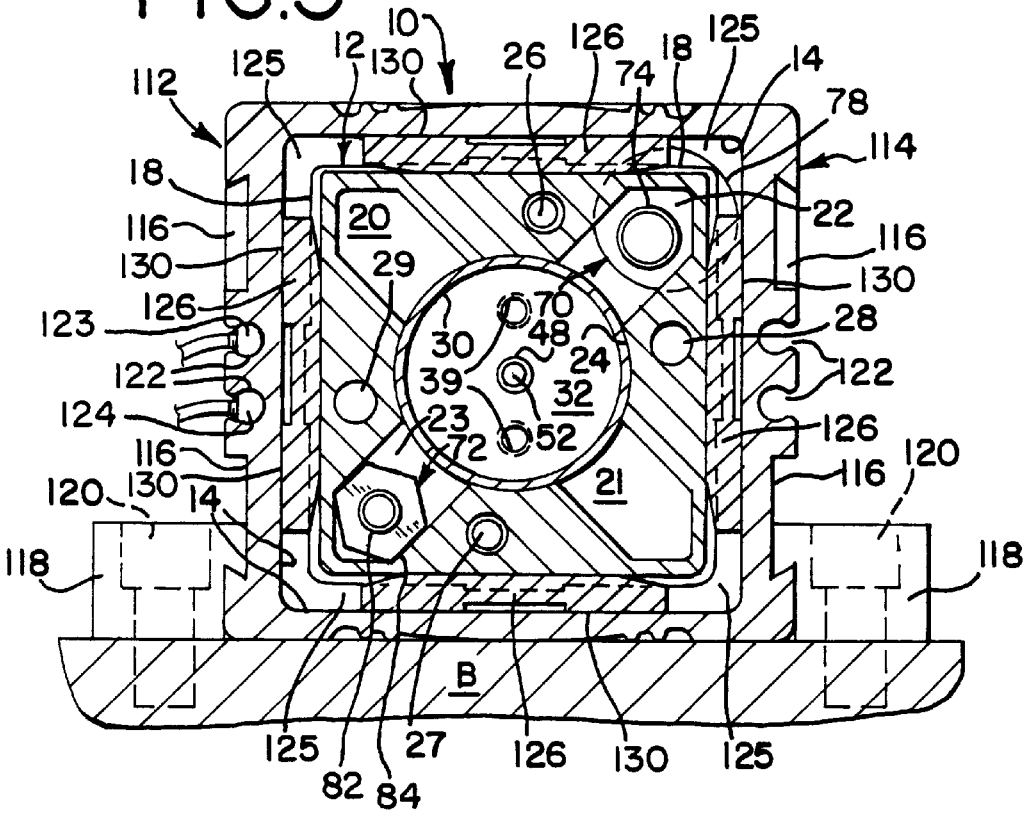
FIG. 3 is a cross-sectioned, end elevation view of the linear thruster as viewed substantially along line 3—3 of FIG. 1.

As best seen in FIG. 3, the load beam 12 is hollowed on the inside to form a plurality of channels 20, 21, 22 and 23 which preferably extend longitudinally of the length of the elongate load beam 12 from one end to the other and generally parallel to the axis a of the load beam 12. The channels 20–23 also preferably extend radially outwardly in a cruciform fashion as shown from a large generally circular bore 24, the latter of which also extends along the axis a as seen in FIGS. 5–8.

Figure 5:
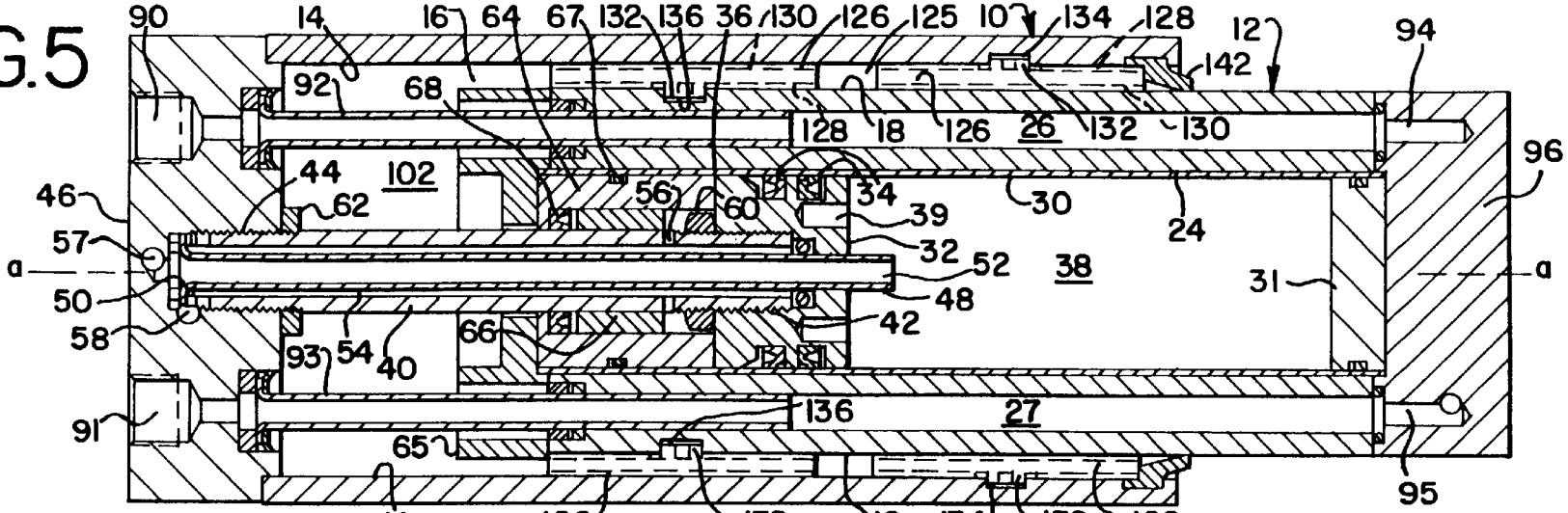
FIG. 5 is a cross-sectioned, side elevation view of the linear thruster as viewed substantially along line 5—5 of FIG. 2, and in which the linear thruster is shown in its extended position.
Figure 6:
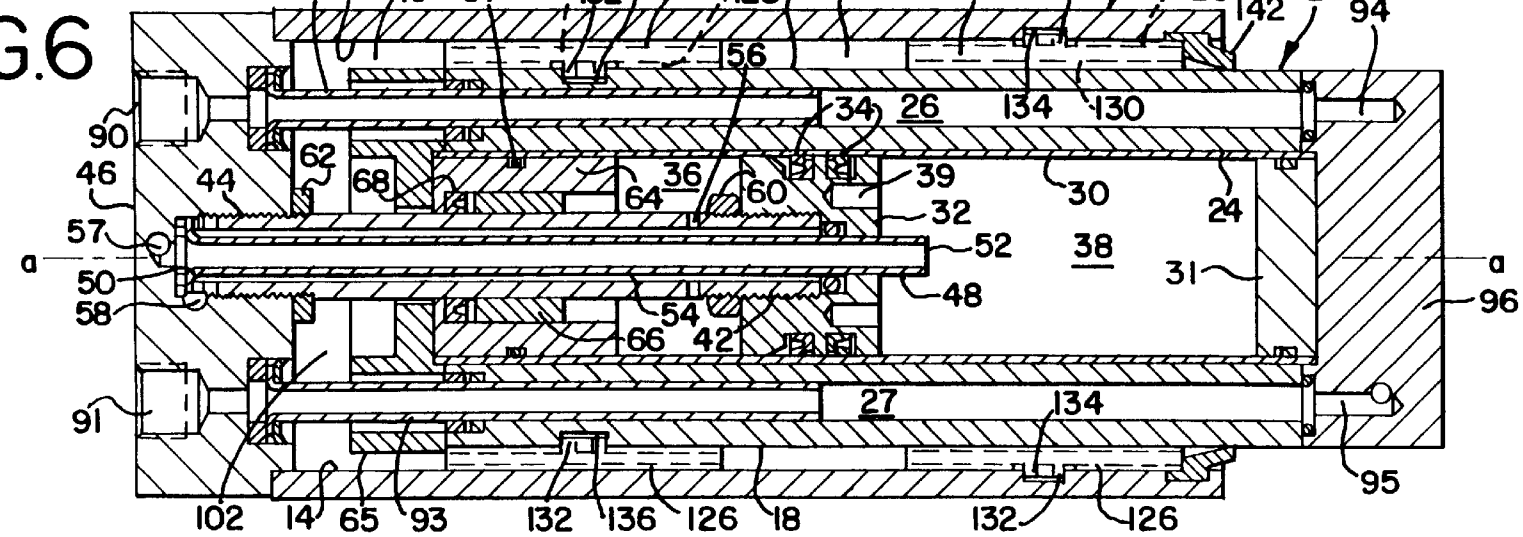
FIG. 6 is a cross-sectioned, side elevation view of the linear thruster as substantially shown in FIG. 5, but in its retracted position.

In addition to the channels 20–23, a plurality of channels 26–29 also extend over the length of the load beam 12, in radially spaced relationship to the longitudinal axis a of the load beam, and between the respective channels 20, 21, 22 and 23 as best seen in FIGS. 3, 5 and 6. The purposes and functions of the channels 20–23 and the channels 26–29 will be further described in detail below.

A cylindrical sleeve 30 is positioned within the circular bore 24 in fixed relationship to the load beam 12 but movable therewith. The right end of the sleeve 30 as viewed in the drawings is sealed with a sleeve plug 31, and a piston 32 is positioned in the sleeve 30 as best seen in FIGS. 5–8. The sleeve 30 moves relative to the piston and with the load beam 12 during operation of the linear thruster. The piston 32 includes appropriate piston seals 34 as necessary to form a seal between the surfaces of the piston 32 and the cylindrical sleeve 30 to thereby define pressurized fluid receiving chambers 36 and 38 on opposite sides of the piston 32 as best seen in FIGS. 5–8.

One or more short dead ended channels 39 are also preferably provided in the right face of the piston 32, as best seen in FIGS. 3 and 5–8. Although these channels 39 are not generally necessary to the function of the linear thruster, they assist in the assembly or disassembly of the thruster components during manufacture or repair by providing sites for the attachment of a suitable holding or positioning tool.

A piston rod 40 is threaded at one end 42 into the piston 32, and the other end 44 is stationarily fixed into the guide beam end cap 46, also preferably by threading. As best seen in FIGS. 5–8, a fluid tube 48 is also stationarily fixed at its left end 50 in the guide beam end cap 46. The fluid tube 48 preferably extends over the length of the piston rod 40 and through the piston 32 to open therebeyond in fluid chamber 38. The outer diameter of the fluid tube 48 is preferably somewhat less than the inner diameter of the tubular piston rod 40, as best seen in FIGS. 5–8. Accordingly, in addition to the fluid passage 52 in the fluid tube 48 which conducts fluid from the guide beam end cap 46 for discharge into the fluid chamber 38, an annular fluid passage 54 is also defined between the tubular piston rod 40 and fluid tube 48. The annular passage 54 conducts fluid between the guide beam end cap 46 through radially extending passages 56 and the fluid chamber 36 to the left of the piston 32, again as best seen in FIGS. 5–8. The passages 52 and 54, respectively, communicate to the exterior of the linear thruster through the end cap 46 via passages 57 and 58, respectively, in the end cap 46.

As previously mentioned, the piston rod end 42 is preferably threaded into the piston 32. It is held in stationary relationship with the piston by way of a jam nut 60, as best seen in FIGS. 5–8. A jam nut 62 is also preferably provided at the other end of the piston rod 40 to ensure that the threaded end 44 remains in secure threaded relationship in the guide beam end cap 46. Thus, it will be appreciated that the piston rod 40 and piston 32 remain stationarily fixed to the guide beam end cap 46 during operation of the linear thruster, and the load beam 12 and its cylindrical sleeve 30 will move reciprocally to the right and left as viewed in FIGS. 5–8 relative to the stationary piston 32. This arrangement in the present invention has the advantage of facilitating the porting of fluid to and from the chambers 36 and 38 utilizing passages of minimal length and which consume minimal space, which are entirely internal to the linear thruster, and which may be supplied with fluid from one end of the thruster via inlet passages 57 and 58. Moreover, there is no need for a separate fluid cylinder for operating the load beam. This simplifies not only the manufacture but also the operation of the linear thruster of the invention. Importantly, this also reduces the number of parts needed while strengthening the assembly against side loads F or moments M1 and M2 as viewed in FIG. 1.

A rod guide 64 is also positioned about the piston rod 40, again as best seen in FIGS. 5–8. The rod guide 64 is generally held seated against the load beam end plate 65 either by the fluid pressure in chamber 36 and/or by the direction of motion of the load beam 12. Thus, the rod guide 64 slides relative to the outer surface of the tubular piston rod 40 and moves with the load beam 12. Accordingly, the rod guide 64 is provided with annular bearings 66 to facilitate its longitudinal motion relative to the outer surface of the piston rod 40. The rod guide 64 is also provided with appropriate fluid seals 67 and 68, as best viewed in FIGS. 5–8.

Figure 2:
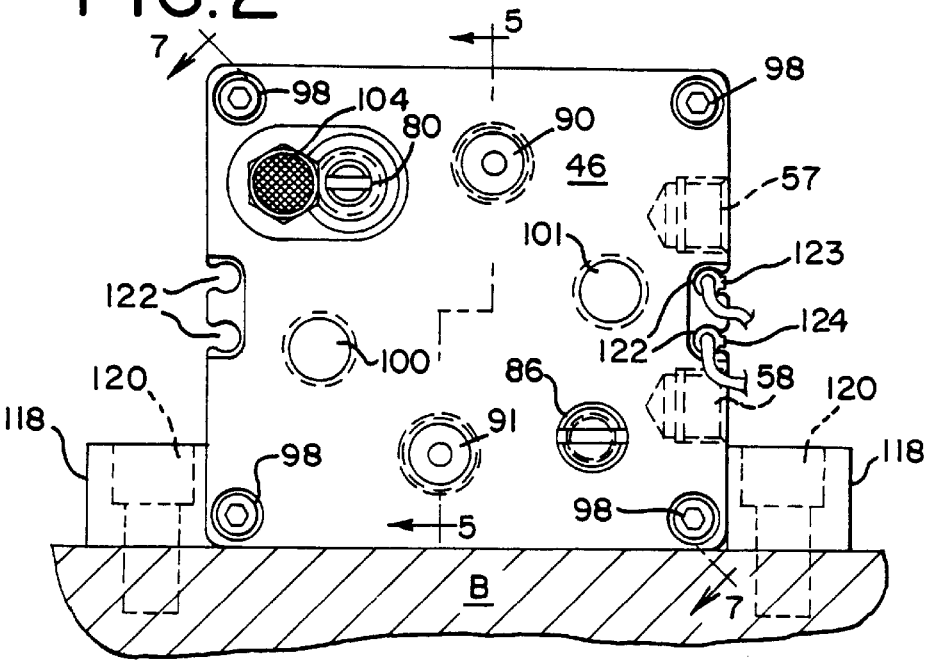
FIG. 2 is an end elevation view of the linear thruster as viewed substantially along line 2—2 of FIG. 1.
Figure 7:
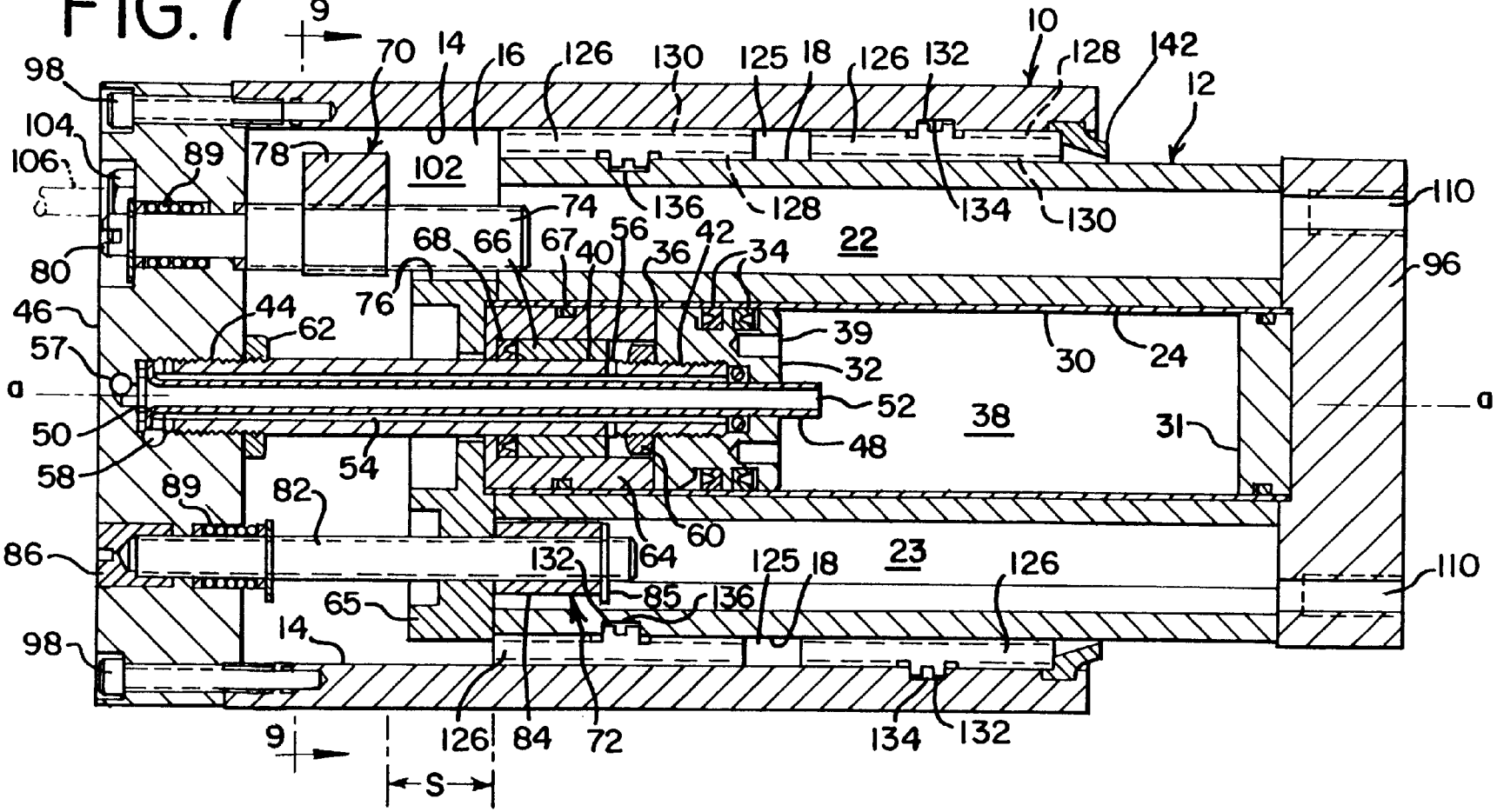
FIG. 7 is a cross-sectioned, side elevation view of the linear thruster as viewed substantially along line 7—7 of FIG. 2, and in which the linear thruster is shown in its extended position.
Figure 8:
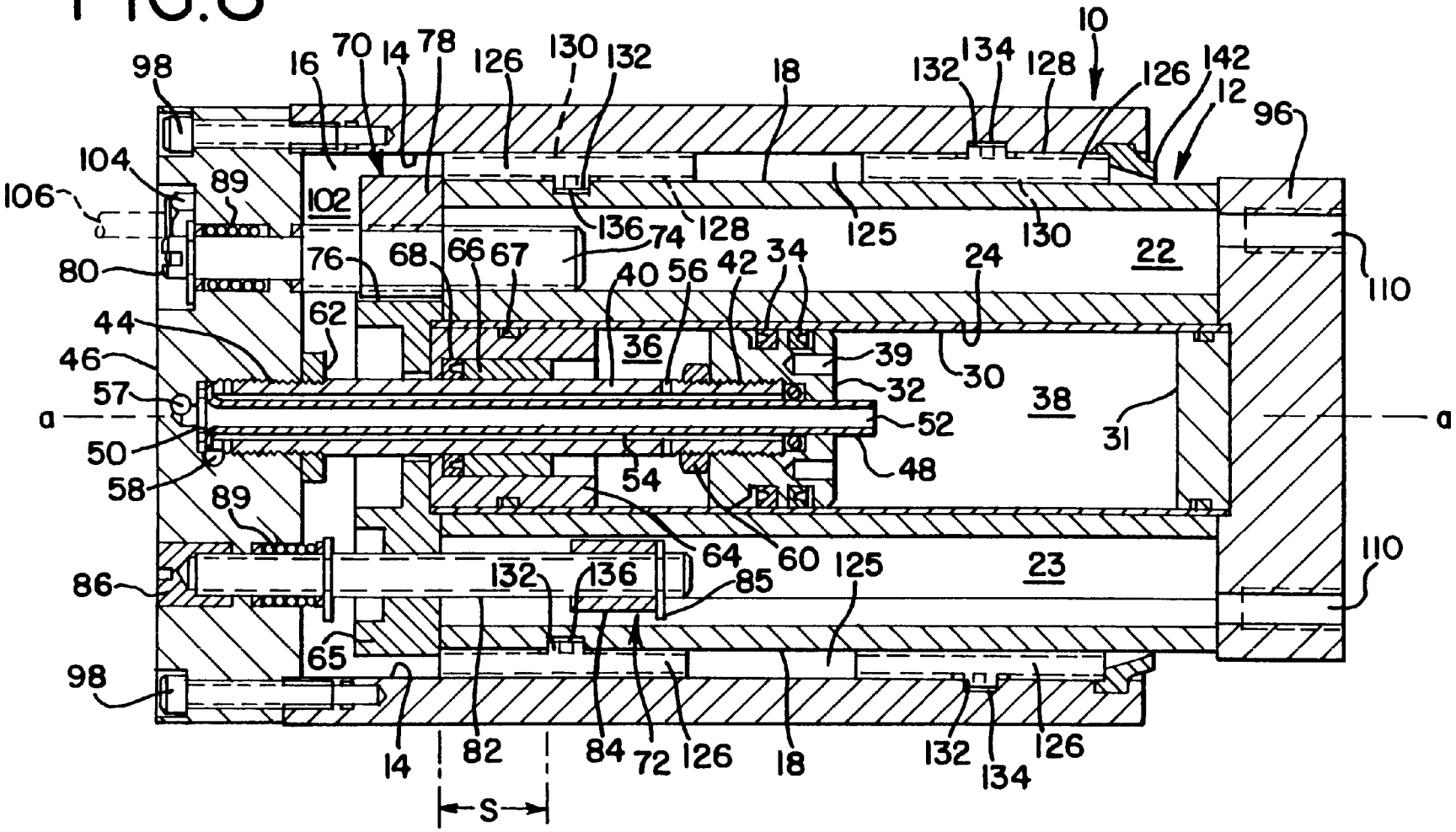
FIG. 8 is a cross-sectioned, side elevation view of the linear thruster as substantially shown in FIG. 7, but in its retracted position.
Figure 12:
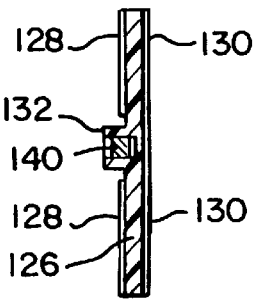
FIG. 12 is a cross-sectioned, side elevation view of the load bearing plate as viewed substantially along line 12—12 of FIG. 11.
Figure 9:
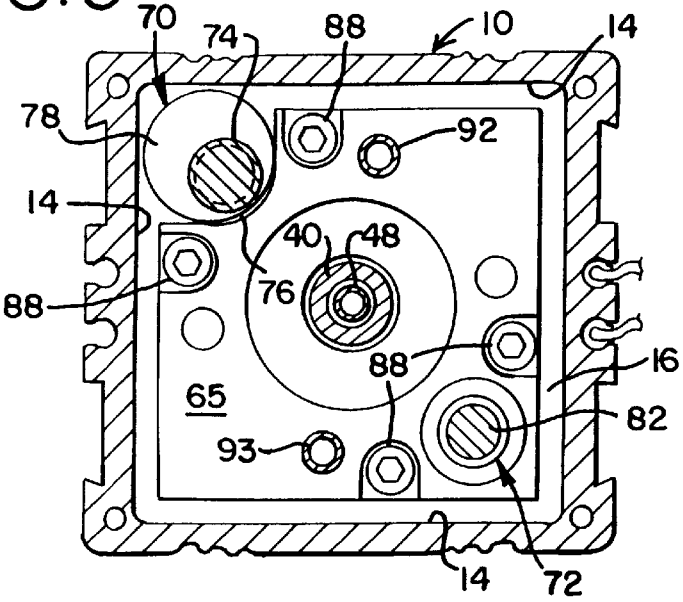
FIG. 9 is a cross-sectioned, end elevation view of the linear thruster as viewed substantially along line 9—9 of FIG. 7.

Returning to the cruciform channels 20–23, their principal purpose is to accommodate any one of a variety of linear thruster components that may be necessary or useful in the operation of the linear thruster. For example with particular reference to FIGS. 3, 7 and 8, it will be seen that channels 22 and 23 have been utilized to internally accommodate externally adjustable left and right stroke limit stops 70 and 72, respectively. The left stroke limit stop 70 preferably comprises an elongate threaded pin 74 which passes through a notch 76 in the upper corner of the load beam end plate 65 as seen in FIG. 9, and into the one of the cruciform channels 22 of the load beam 12. An eccentric stroke adjusting nut 78, as best seen in FIGS. 7–9, threadedly engages the pin 74, and the left end of the pin extends through and to the exterior of the guide beam endcap 46 at which point it has a slotted head 80, as shown in FIGS. 2, 7 and 8, for back and forth adjustment of the stroke adjusting nut 78. Thus, as the pin 74 is rotated, the nut 78 will move to the right or left to change the position at which the left end of the load beam 12, as seen in FIGS. 7 and 8, will contact the nut 78. This will permit variable adjustment of the stroke S of the load beam 12.

Similarly the right stroke limit stop 72 also includes a pin 82 which extends through the load beam end plate 65 and into the cruciform channel 23, as best seen in FIGS. 7–9. The pin 82 is also preferably threaded and includes a hex nut 84 which may be moved back and forth upon rotation of the pin 82. A restraining ring 85 is preferably provided to prevent the hex nut 84 from being turned off the end of the pin 82, and the hex nut 84 is restrained from rotation due to its shape and the shape of the walls of the channel 23. Like the pin 74, for the left stroke limit stop 70, the pin 82 also includes a slotted head 86 external of the guide beam end cap 46 to permit external rotation of the pin 82. Accordingly, as the pin 82 is rotated, the hex nut 84 will move back and forth in the channel 23 so as to engage the right side of the load beam end plate 65 sooner or later to adjust the stroke S by limiting the movement of the load beam 12 to the right as viewed in the drawings. It will be seen that the load beam end plate 65 is fixed to the left end of the load beam 12 by bolts 88, as best seen in FIG. 9. Suitable springs 89 may also be provided, as shown in FIGS. 7 and 8, to load the pins 74 and 82 in a well known manner to maintain their adjustment positions during operation of the linear thruster.

In addition to the adjustable left and right stroke limit stops 70 and 72 which are accommodated by the cruciform channels 22 and 23, channels 21 and 22 may also be utilized to internally accommodate other components of the linear thruster. For example channels 21 and 22 may be utilized, respectively, to provide for passage of electrical conductors between the guide beam end cap 46 and the tool T, as shown in FIG. 1, to be mounted at the outer right end of the load beam 12 and be moved by the linear thruster. Such conductors may for example be telescopic or spring-like to accommodate the extension and retraction of the load beam 12. Moreover, a linear variable resistor such as those well known in the art may be installed in one of these channels 21, 22 to provide an analog readout of the position of the thruster at any given time if desired. Neither of these are shown in the drawings for purposes of simplicity.

Figure 4:
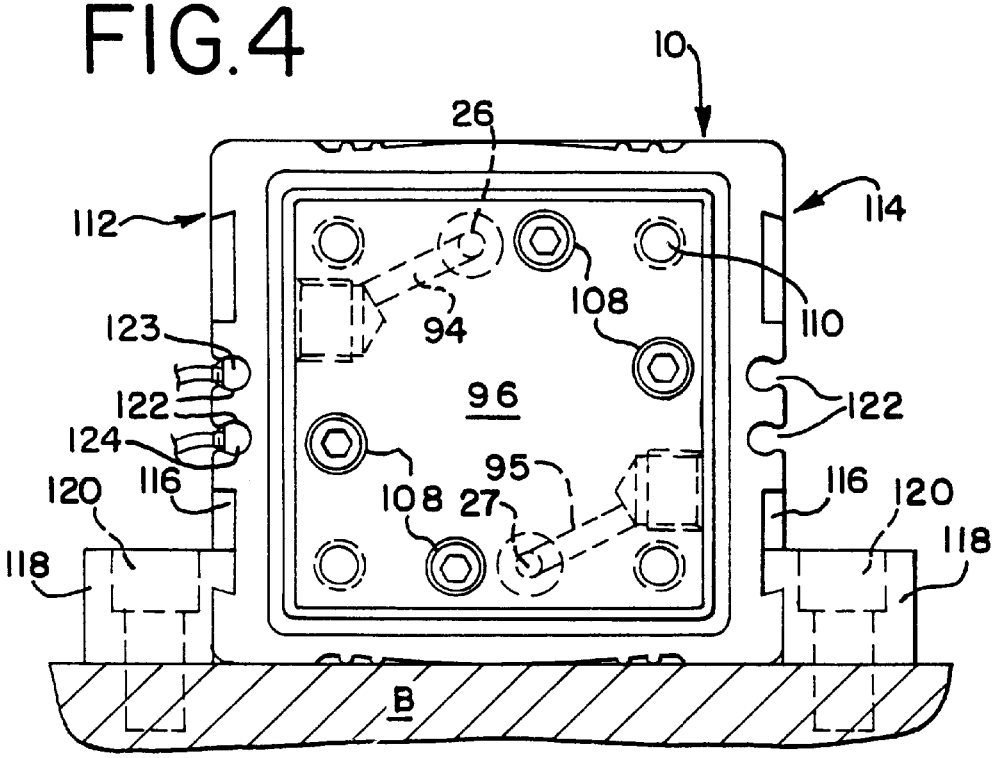
FIG. 4 is an end elevation view of the linear thruster as viewed substantially along line 4—4 of FIG. 1.

As previously mentioned, the channels 26–29 may also be utilized to communicate energy between the left and right sides of the linear thruster, as viewed in the drawings, for the tool T. Referring particularly to FIGS. 2–6, pressurized fluid may be transmitted from ports 90 and 91 through fluid tubes 92 and 93 which pass through openings in the load beam end plate 65 and discharge into the channels 26 and 27 as viewed in FIGS. 5 and 6. In turn, the channels 26 and 27, as seen in FIG. 4, communicate with passages 94 and 95 in the tooling plate 96 the latter of which is adapted to carry the tool T to be maneuvered by the linear thruster of the invention. In the alternative, these channels 26, 27 or the other channels 28, 29 may also be utilized to accommodate appropriate electrical conductors for the transmission of electrical energy between the ends of the linear thruster. Whether or not all of the channels 26–29 are used, four are shown to ensure balance of the load beam 12.

As best seen in FIGS. 2, 7 and 8, the guide beam end cap 46 is stationarily fixed to the left end of the multisided guide beam 10 for example by bolts 98. In addition ports 100 and 101, as seen in FIG. 2, are also provided to communicate with channels 28 and 29 as may be needed. If they are not used, they may simply be plugged.

It also will be appreciated that the chamber 102 between the guide beam end cap 46 and the left end of the load beam 12, as viewed in the drawings, should preferably be vented during the operation of the linear thruster between its retracted and extended positions. For this purpose a simple filter 104, for example a sintered metal filter, may be provided for the ingress and egress of ambient air into chamber 102 as the load beam 12 moves. In the alternative if the linear thruster is to be used in a "clean room" environment, the filter 104 may be replaced by a vacuum line 106 as shown in dot and dash in FIGS. 7 and 8.

As shown in FIGS. 1 and 4, the tool mounting or right end of the linear thruster as shown in the drawings includes a tooling plate 96 which is preferably bolted on the right end of the load beam 18 with bolts 108. Additional openings 110 may also be provided as desired to communicate fluid or electrical energy through the tooling plate 96 as may be desired, in addition to the fluid passages 94 and 95 already described.

In view of the multisided, polygonal or square preferred cross-sectional shapes, particularly of the guide beam 10, the guide beam and/or both beams will typically be preferably formed by extrusion of a suitable metal such as aluminum. In view of this, it is relatively easy to custom design the surfaces of one or more of the exterior faces of the guide beam 10 to include customized channels to satisfy particular and unique functions. For example as seen in FIGS. 1, 3 and 4, opposite exterior faces 112 and 114 may be formed with longitudinally extending dovetailed channels 116 extending adjacent and preferably parallel to the corners of the guide beam 10. As will be seen in the drawings, these dovetailed channels 116 may be utilized to accommodate hold down lugs 118 to permit firmly mounting the linear thruster and lugs with bolts 120 to a foundation base B.

Figure 10:
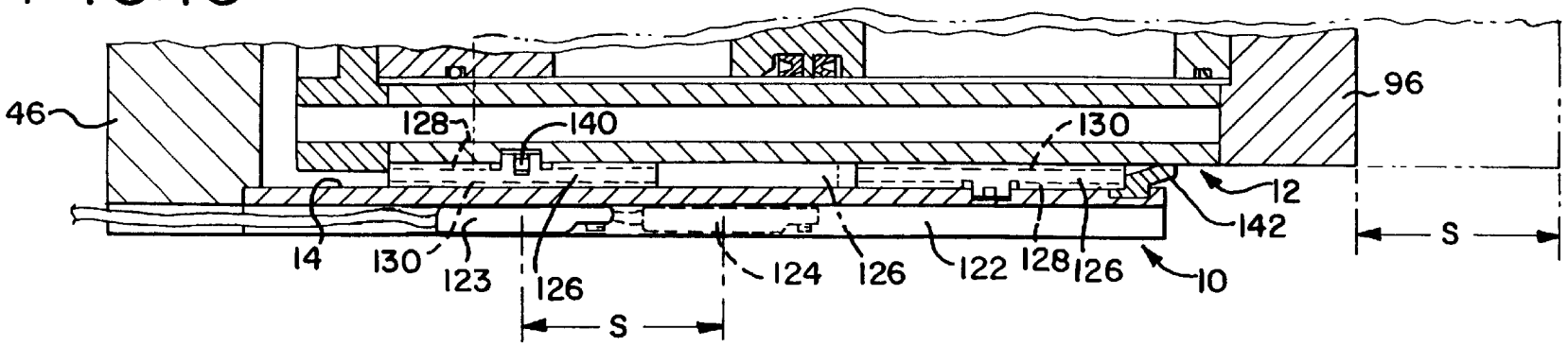
FIG. 10 is a slightly enlarged, partial, cross-sectioned view of the linear thruster and showing a preferred arrangement of load bearing plates and position sensing system, and showing the linear thruster in both its extended and retracted positions.

In addition, channels 122 of a different and possibly more circular cross-section may also be formed on exterior faces 112, 114 or other exterior faces for the purpose of slidingly receiving ancillary features to the linear thruster, such as magnetic position sensors 123 and 124 as shown in FIGS. 1–4, 9 and 10. Although the conductor wires for the sensors 123 and 124 are shown as extending from the channels 122 for purposes of illustration, these wires are also preferably run through the channels as shown in FIG. 10 to protect them from exposure and possible damage.

Extruded tubing, such as the square multisided tubing of the present invention, typically may not be as readily capable of attaining close tolerances as are components formed by more precise machining methods. However, close tolerances are not necessary in the multisided linear thruster of the present invention due to the unique bearing pads and low friction coatings preferably employed in the present invention.

As extruded, the dimensions between the inner walls 14 of the guide beam 10 may purposely be markedly greater than the dimensions between the outer walls 18 of the load beam 12 to define a space 125 between these walls. A plurality of bearing plates 126 are molded of a suitable low friction, wear resistant polymer such as Delryn, PTFE or combinations thereof. As shown in FIGS. 5–8 and 10–12, each of the bearing plates 126 is formed so as to have raised bearing pads 128 and 130 on its opposite sides. The bearing pads 128 and 130 can be broached, milled or ground to a thickness approximately equal to the spacing 125 between the inner walls 14 of the guide beam 10 and corresponding outer walls 18 of load beam 12. Thus, close tolerances need not be maintained between these walls because the thickness of the bearing plates 126 may simply be adjusted to fit the spaces 125 between these walls.

Each of the bearing plates 126 also includes a rib 132 which extends from one of the faces of each bearing plate. The rib 132 is adapted to be received either in a groove 134 extending across the width of the inner walls 14 of the guide beam, as best seen in FIGS. 5–8, or a groove 136 extending across the width of the outer walls 18 of the load beam 12. Thus, it will be seen that a pair of longitudinally spaced bearing plates 126 preferably are provided for each side of the load beam 12. The four bearing plates to the right on the guide beam 10 are positioned to have their ribs 132 facing outwardly and into the grooves 134 on the inner walls 14 of the guide beam. Thus, these right hand bearing plates 126 remain stationary during the operation of the linear thruster, and do not move relative to the guide beam 10. However, they do provide substantial surface to support and guide the load beam 12 outer walls 18 for sliding movement against the bearing pads 130 during operation of the linear thruster. Conversely, the bearing plates 126 to the left as viewed in the drawings are turned over upside down relative to the right hand bearing plate so that their ribs 132 enter the grooves 136 on the outer walls 18 of the load beam 12. Accordingly, they are fixed to move with the load beam 12 as the load beam moves between its extended and retracted positions, and their bearing pads 130 also provide substantial surface to support and guide and load beam 12 for sliding movement against the inner walls 14 of the guide beam 10.

Figure 11:
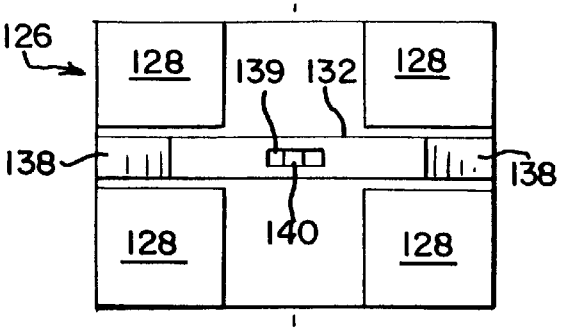
FIG. 11 is a plan view of a preferred embodiment of load bearing plate of the invention.

Referring to FIG. 11, the opposite ends of the ribs 132 are preferably inclined at 138 to facilitate the sliding insertion or removal of the bearing plates 126 in their respective grooves 134 or 136. Also, some or all of the bearing plates 126 may be formed with a recess 139 which contains a small piece of magnetic material 140 to cooperate with the magnetic position sensors 123, 124 as shown in FIG. 10.

The inner walls 14 of the guide beam 10 and the outer walls 18 of the load beam 12 are preferably treated in a manner to render them somewhat porous, such as by anodizing. These relatively porous walls are then preferably coated or impregnated and the pores filled with a low friction, long wearing solid polymer such as Delrin, PTFE or mixtures thereof. Thus, the friction between the bearing pads 130 of the bearing plates 126 and the respective inner and outer walls 14 and 18 which are in sliding contact therewith is reduced to a minimum.

In order to prevent the ingress of dirt and other contaminants to the low friction surfaces provided by the coatings on the inner and outer walls 14 and 18 and the bearing plate 126, a wiper seal 142 of a flexible material is preferably mounted about the right end opening of the guide beam 10. The wiper seal 142 is positioned to bear against the outer walls 18 of the load beam 12 particularly when the load beam is moving to the left to its retracted first position to ensure that particulate and other contaminants are precluded from being drawn into the guide beam 10.

Although it is believed that the operation and substantially improved performance and advantages will be apparent to those skilled in the art from the foregoing description of the preferred embodiment of linear thruster of the invention, a brief description of the operation and function follows.

It will initially be assumed that the linear thruster is in its retracted position as shown in FIGS. 6 and 8. In this position, fluid under pressure will be admitted through passage 57, the fluid passage 52 of the fluid tube 48, and discharged into fluid chamber 38. This fluid will exert a pressure on the face of piston 32 and the sleeve plug 31. However, because the piston 32 is fixed and does not move, the sleeve plug 31 will move to the right as viewed in the drawings together with the load beam 12 to which it is attached and the rod guide 64, until the load beam 12 is in its fully extended condition as shown in FIGS. 5 and 7. As the load beam 12 moves to the right, the chamber 36 will be vented to prevent a fluid lock which might hamper or prevent movement. This venting will take place through the radial passages 56, annular fluid passage 54 about the fluid tube 48, and passage 58 to the exterior of the linear thruster. Space 102 is also vented through the filter 104 or vacuum line 106. Also during this movement of the load beam 12 to the extended position, the rod guide 64 and its bearing 66 and seal 68 will move to the right as viewed in the drawings along the exterior surface of the stationary piston rod 40.

Movement of the load beam 12 to the right will be limited by the right stroke limit stop 72, as best seen in FIG. 7. Both the left stroke limit stop 70 and right stroke limit stop 84 may be adjusted to adjust the stroke by rotation of one or both of the pins 74 and 82 by their exteriorly positioned slotted heads 80 and 86.

When the load beam 12 has reached its extended position, that position will be sensed by the magnetic position sensor 124 as seen in FIG. 10. The sensor 124 is actuated by the magnet 140 in the bearing plate 126 which will move into alignment with sensor 124. That signal may be utilized to control appropriate fluid control valves or electrical switches to initiate the operation of the tool T which is mounted on the tooling plate 96. For example, fluid may be ported and/or vented through ports 90 and 91, fluid tubes 92 and 93, channels 26 and 27 and passages 94 and 95 to operate the tool T which has now been positioned in its extended working position. The tool T may for example be a rotary actuator whose output shaft is pneumatically rotated by air.

When it is desired to retract the linear thruster from its extended position as shown in FIGS. 5 and 7 to its retracted position as shown in FIGS. 6 and 8, the foregoing steps are simply reversed. Pressurized fluid is now admitted to the passage 58, annular fluid passage 54 and radial passages 56 into the chamber 36. Again because the piston 32 is stationary, the pressurized fluid will bear against the left face of the piston 32 and the right face of the rod guide 64 to drive the rod guide to the left as viewed in the drawings. Thus, the rod guide 64 will bear against the load beam end plate 65, the latter of which is fixed to the load beam 12, to move the load beam to the left until the left end of the load beam comes to bear against the adjustment nut 78 of the left stroke limit stop 70 as shown in FIG. 8. Arrival of the load beam 12 to this retracted position may be sensed if desired by magnetic position sensor 123 which detects the arrival and alignment of the magnet 140 in the bearing plate 126 with the left sensor 123 as shown in FIG. 10.

In view of the foregoing, it will be appreciated that due to the multisided cross-sectional shape of the inner walls 14 of the guide beam 10 and its passage 16, together with the substantially complementary, multisided cross-sectional shape of the outer walls 18 of the load beam 12, the available linear bearing and guide surface areas of the respective walls of the beams are extremely large. This large linear bearing and guide surface area afforded by the multisided construction of the linear thruster of the present invention substantially strengthens the linear thruster of the invention against the moments M1 and M2 as well as against the side load forces F as shown in FIG. 1. This strengthening will also substantially reduce deflection. All of these are accomplished without any increase in the volumetric space occupied by the linear thruster and, in fact, with a substantial reduction in such space requirements over the requirements of at least some of the prior linear thrusters. It will also be seen that the structural complexity of the thrusters of the present invention is simplified, the expense is reduced and the ease of manufacture is simplified, and the potential for miniaturization is maximized.

It will also be seen that fluid or electrical energy transmission to the tool as well as ancillary components, such as the stroke limit stops, may be located interior of the linear thruster, and the fluid and control fittings may all be located at the same end of the guide beam 10, rather than at opposite ends or along its length. This permits further miniaturization and maximizes the ability to locate components within the interior of the thruster so as to present a clean profile and protect the components against damage during operation and use. In addition, it will be appreciated that in the preferred embodiment of linear thruster of the present invention "pinch points" that might have been present in the prior linear thrusters are virtually eliminated. This substantially reduces the possibility of serious personnel injury during use.

It will also be appreciated from the foregoing that the formation of the fluid power cylinder for the operation of the linear thruster as an intimate part of the movable load beam and to move with it, and that the piston is fixed permits a substantial reduction in material needed to form the cylinder because the cylinder is directly supported by the load beam. Moreover, the pressurized operating fluid may be readily communicated to and from piston through the piston rod because both are stationary. This greatly reduces the complexity of the thruster and shortens the fluid path to permit reduction in size and weight of the linear thruster and improve its strength, and also extends the life of the piston rod seals.

Still another principal advantage of the present invention that will be appreciated from the foregoing description is that the exterior of the linear thruster may be formed for example by extrusion with functional ridges, grooves and channels which may be capable of accommodating fastening mechanisms for easily fastening the linear thruster itself to a base plate, or to accommodate position sensors or other ancillary components. Moreover, the linear thrusters of the invention have the advantage that the load beams are relatively simple to manufacture and are accepting of relatively large tolerances without detrimental effect to their operation. And, the linear thruster of the present invention may be simply adapted to clean room use.

Although the term "fluid" as employed herein is preferably a gas or air, it will be appreciated that it may also include liquid.

It will also be appreciated that although the embodiment described includes adjustable stroke limit stops, such stops may be eliminated without departing from the invention, and other mechanisms within the skill of those in the art may be employed to define the stroke length.

It will also be understood that the preferred embodiment of the present invention which has been described is merely illustrative of the principles of the present invention. Numerous modifications may be made by those skilled in the art without departing from the true spirit and scope of the invention.

We claim:

1. A fluid operated linear thruster comprising:

a guide beam having an elongate passage therein defined by internal walls in said guide beam;

a load beam positioned in said passage of said guide beam for reciprocation therein, said load beam having an outer wall which is sized and shaped so as to be supported and guided at least at two spaced locations on said internal walls of said guide beam during reciprocation of said load beam in the passage of said guide beam;

at least one of said passages of said guide beam and said outer wall of said load beam being multisided in cross-section;

a mounting on said load beam to mount a load thereon for movement with said reciprocating load beam;

a piston in said load beam, said load beam being reciprocally movable relative to said piston;

a fluid inlet for communicating a source of fluid under pressure to at least one side of said piston to urge said load beam to reciprocally move in said passage and relative to said piston, and between a first position and a second position while being supported and guided by said at least two spaced locations;

wherein said load beam has an elongate axis, and a plurality of channels opening to at least one end of said load beam, spaced from each other, extending longitudinally of and within said load beam and substantially parallel to and radially spaced from said axis;

wherein said plurality of channels includes at least one channel which extends the length of said load beam to said mounting on said load beam, and said at least one channel is constructed and arranged relative to said mounting to communicate at least one of fluid and electrical energy to said mounting on said load beam when said load beam is in said second position and in which it is extended from said guide beam; and a tube mounted on an end of said guide beam opposite said mounting on said load beam, said tube extending into said at least one said channel, and said load beam is also reciprocally movable relative to said tube.

2. The linear thruster of claim 1, wherein said passage in said guide beam is multisided in cross-section.

3. The linear thruster of claim 2, wherein said load beam outer wall is also multisided in cross-section.

4. The linear thruster of claim 3, wherein the multisided cross-sections of said internal walls of said guide beam and said outer wall of said load beam, respectively, are of substantially the same shape.

5. The linear thruster of claim 3, wherein said multisided cross-sections are substantially square.

6. The linear thruster of claim 1, wherein said load beam is located substantially within said guide beam when in said first position, said guide beam has first and second opposite ends, and said load beam extends from said first end of said guide beam when said load beam is in said second position.

7. The linear thruster of claim 6, wherein said piston includes a piston rod, and said piston rod is mounted at said second end of said guide beam.

8. The linear thruster of claim 7, wherein said piston rod is stationarily mounted at said second end of said guide beam.

9. The linear thruster of claim 7, wherein said fluid inlet communicates the fluid under pressure to said at least one side of said piston through said piston rod.

10. The linear thruster of claim 7, wherein said fluid inlet comprises at least first and second fluid inlets to communicate a source of fluid under pressure to opposite sides of said piston, and both of said first and second fluid inlets are positioned on said guide beam adjacent said second end of said guide beam.

11. The linear thruster of claim 10, wherein said fluid is communicated to the opposite sides of said piston through said piston rod.

12. The linear thruster of claim 1, wherein said piston is stationarily mounted relative to said guide beam, and said load beam is reciprocally movable relative to said piston.

13. The linear thruster of claim 1, wherein said guide beam is extruded to form said multisided cross-section.

14. The linear thruster of claim 13, including at least one channel extruded on the exterior of said guide beam.

15. The linear thruster of claim 14, including fastening means engaging said extruded channel for mounting said linear thruster to a base.

16. The linear thruster of claim 14, wherein said channel is substantially dovetail in cross-section.

17. The linear thruster of claim 14, including position sensing means engaging said extruded channel for sensing the position of said load beam.

18. The linear thruster of claim 1, including adjustment means for adjusting the distance between said first and second positions, said adjustment means being adjustable from the exterior of said guide beam and cooperating with at least one channel of said plurality of channels.

19. The linear thruster of claim 1, wherein at least some of said plurality of channels are formed longitudinally through said load beam by extrusion.

20. The linear thruster of claim 1, including a wiper which engages said outer wall of said load beam during reciprocation of the load beam to remove contaminants therefrom.

21. A fluid operated linear thruster, comprising:

a guide beam having an elongate passage therein defined by internal walls in said guide beam;

a load beam positioned in said passage of said guide beam for reciprocation therein, said load beam having an outer wall which is sized and shaped so as to be supported and guided at least at two spaced locations on said internal walls of said guide beam during reciprocation of said load beam in the passage of said guide beam, said load beam having an elongate axis and a plurality of channels opening to at least one end of said load beam, spaced from each other, extending longitudinally of and within said load beam and substantially parallel to and radially spaced from said axis;

at least one of said passage of said guide beam and said outer wall of said load beam being multisided in cross-section;

a mounting on said load beam to mount a load thereon for movement with said reciprocating load beam;

a piston in said load beam;

a fluid inlet for communicating a source of fluid under pressure to at least one side of said piston to urge said load beam to reciprocally move in said passage between a first position and a second position while being supported and guided by said at least two spaced locations;

wherein said plurality of channels includes at least one channel which extends the length of said load beam to said mounting on said load beam, and said at least one channel is constructed and arranged relative to said mounting to communicate at least one of fluid and electrical energy to said mounting on said load beam when said load beam is in said second position and in which it is extended from said guide beam; and a tube mounted on an end of said guide beam opposite said mounting on said load beam, said tube extending into said at least one said channel, and said load beam is also reciprocally movable relative to said tube.

22. The linear thruster of claim 21, including adjustment means for adjusting the distance between said first and second positions, said adjustment means being adjustable from the exterior of said guide beam and cooperating with at least one channel of said plurality of channels.

23. The linear thruster of claim 21, wherein at least some of said plurality of channels are drilled longitudinally through said load beam.

24. The linear thruster of claim 21, wherein at least some of said plurality of channels are formed longitudinally through said load beam by extrusion.

25. A fluid operated linear thruster, comprising:

a guide beam having an elongate passage therein defined by internal walls in said guide beam;

a load beam positioned in said passage of said guide beam for reciprocation therein, said load beam having an outer wall which is sized and shaped so as to be supported and guided at least at two spaced locations on said internal walls of said guide beam during reciprocation of said load beam in the passage of said guide beam, said load beam having an elongate axis and a plurality of channels opening to at least one end of said load beam, spaced from each other, extending longitudinally of and within said load beam and substantially parallel to and radially spaced from said axis, said guide beam internal walls and said load beam outer wall being spaced from each other;

at least one bearing member positioned in the space between said walls to support and guide said load beam at said at least two spaced locations during said reciprocation;

at least one of said passage of said guide beam and said outer wall of said load beam being multisided in cross-section;

a mounting on said load beam to mount a load thereon for movement with said reciprocating load beam;

a piston in said load beam;

a fluid inlet for communicating a source of fluid under pressure to at least one side of said piston to urge said load beam to reciprocally move in said passage between a first position and a second position while being supported and guided by said at least two spaced locations;

wherein said plurality of channels includes at least one channel which extends the length of said load beam to said mounting on said load beam, and said at least one channel is constructed and arranged relative to said mounting to communicate at least one of fluid and electrical energy to said mounting on said load beam when said load beam is in said second position and in which it is extended from said guide beam; and a tube mounted on an end of said guide beam opposite said mounting on said load beam, said tube extending into said at least one said channel, and said load beam is also reciprocally movable relative to said tube.

26. The linear thruster of claim 25, wherein said bearing member is formed of a solid, low friction polymer.

27. The linear thruster of claim 25, including a rib and a groove, said rib being positioned on either said bearing member or on a complementary one of said walls, and said groove being positioned on the other of either said bearing member or complementary one of said walls, and said rib being positioned in said groove to prevent said bearing member from moving relative to the complementary one of said walls.

28. The linear thruster of claim 25, including a wiper which engages said outer wall of said load beam during reciprocation of the load beam to remove contaminants therefrom.

29. A fluid operated linear thruster, comprising:

a guide beam having an elongate passage therein defined by internal walls in said guide beam;

a load beam positioned in said passage of said guide beam for reciprocation therein, said load beam having an outer wall which is sized and shaped so as to be supported and guided at least at two spaced locations on said internal walls of said guide beam during reciprocation of said load beam in the passage of said guide beam;

at least one of said passage of said guide beam and said outer wall of said load beam being multisided in cross-section;

a mounting on said load beam to mount a load thereon for movement with said reciprocating load beam;

a piston in said load beam, said load beam being reciprocally moveable relative to said piston;

a fluid inlet for communicating a source of fluid under pressure to at least one side of said piston to urge said load beam to reciprocally move in said passage and relative to said piston, and between a first position and a second position while being supported and guided by said at least two spaced locations;

wherein at least one of said guide beam internal walls and said load beam outer wall is coated with a low friction solid polymer substance;

wherein said plurality of channels includes at least one channel which extends the length of said load beam to said mounting on said load beam, and said at least one channel is constructed and arranged relative to said mounting to communicate at least one of fluid and electrical energy to said mounting on said load beam when said load beam is in said second position and in which it is extended from said guide beam; and a tube mounted on an end of said guide beam opposite said mounting on said load beam, said tube extending into said at least one said channel, and said load beam is also reciprocally movable relative to said tube.

30. A fluid operated linear thruster comprising:

a guide beam having an elongate passage therein defined by internal walls in said guide beam;

a load beam positioned in said passage of said guide beam for reciprocation therein, said load beam having an outer wall which is sized and shaped so as to be supported and guided at least at two spaced locations on said internal walls of said guide beam;

at least one of said passage of said guide beam and said outer wall of said load beam being multisided in cross-section;

a mounting on said load beam to mount a load thereon for movement with said reciprocating load beam;

a piston in said load beam, said load beam being reciprocally movable relative to said piston;

a fluid inlet for communicating a source of fluid under pressure to at least one side of said piston to urge said load beam to reciprocally move in said passage and relative to said piston, and between a first position and a second position while being supported and guided by said at least two spaced locations;

wherein said guide beam internal walls and said load beam outer wall are spaced from each other, and at least one bearing member which is formed of a solid, low friction polymer is positioned in the space between said walls to support and guide said load beam at said at least two spaced locations during its reciprocation;

a rib and a groove, said rib being positioned on either said bearing member or on a complementary one of said walls, and said groove being positioned on the other of either said bearing member or complementary one of said walls, and said rib being positioned in said groove to prevent said bearing member from moving relative to the complementary one of said walls;

wherein said plurality of channels includes at least one channel which extends the length of said load beam to said mounting on said load beam, and said at least one channel is constructed and arranged relative to said mounting to communicate at least one of fluid and electrical energy to said mounting on said load beam when said load beam is in said second position and in which it is extended from said guide beam; and a tube mounted on an end of said guide beam opposite said mounting on said load beam, said tube extending into said at least one said channel, and said load beam is also reciprocally movable relative to said tube.

31. A fluid operated linear thruster, comprising:

a guide beam having an elongate passage therein defined by internal walls in said guide beam;

a load beam positioned in said passage of said guide beam for reciprocation therein, said load beam having an outer wall which is sized and shaped so as to be supported and guided at least at two spaced locations on said internal walls of said guide beam during reciprocation of said load beam in the passage of said guide beam;

at least one of said passages of said guide beam and said outer wall of said load beam being multisided in cross-section;

a mounting on said load beam to mount a load thereon for movement with said reciprocating load beam;

a piston in said load beam, said load beam being reciprocally movable relative to said piston;

a fluid inlet for communicating a source of fluid under pressure to at least one side of said piston to urge said load beam to reciprocally move in said passage and relative to said piston, and between a first position and a second position while being supported and guided by said at least two spaced locations; and wherein said guide beam includes a vent to vent said passage of said guide beam to the exterior of said guide beam, and wherein said vent is a vacuum line;

wherein said plurality of channels includes at least one channel which extends the length of said load beam to said mounting on said load beam, and said at least one channel is constructed and arranged relative to said mounting to communicate at least one of fluid and electrical energy to said mounting on said load beam when said load beam is in said second position and in which it is extended from said guide beam; and a tube mounted on an end of said guide beam opposite said mounting on said load beam, said tube extending into said at least one said channel, and said load beam is also reciprocally movable relative to said tube.

* * * * *